US008171898B2

(12) United States Patent
Nagenkögl et al.

(10) Patent No.: US 8,171,898 B2
(45) Date of Patent: May 8, 2012

(54) CRANKCASE BREATHING SYSTEM

(75) Inventors: Günther Nagenkögl, Steyr (AT); Robert Roithinger, St. Valentin (AT); Robert Pöschl, Graz-Andritz (AT); Helmut Altendorfer, Peilstein/Mühl (AT); Andreas Schrattbauer, Hargelsberg (AT); Christof Knollmayr, Graz (AT)

(73) Assignee: AVL List GmbH, Graz (AT)

( * ) Notice: Subject to any disclaimer, the term of this patent is extended or adjusted under 35 U.S.C. 154(b) by 792 days.

(21) Appl. No.: 12/087,928

(22) PCT Filed: Feb. 1, 2007

(86) PCT No.: PCT/AT2007/000048

§ 371 (c)(1),
(2), (4) Date: Jan. 8, 2009

(87) PCT Pub. No.: WO2007/087663

PCT Pub. Date: Aug. 9, 2007

(65) Prior Publication Data

US 2009/0314230 A1 Dec. 24, 2009

(30) Foreign Application Priority Data

| | | |
|---|---|---|
| Feb. 2, 2006 | (AT) | A 155/2006 |
| Mar. 16, 2006 | (AT) | A 434/2006 |
| Mar. 16, 2006 | (AT) | A 435/2006 |
| Mar. 16, 2006 | (AT) | A 436/2006 |

(51) Int. Cl.
*F01P 3/02* (2006.01)

(52) U.S. Cl. ..... 123/41.72

(58) Field of Classification Search .... 123/41.28–41.79, 123/41.82 R, 41.82 A, 193.1–193
See application file for complete search history.

(56) References Cited

U.S. PATENT DOCUMENTS

| | | | | |
|---|---|---|---|---|
| 2,785,664 | A * | 3/1957 | Goldsmith | 123/41.31 |
| 4,193,310 | A | 3/1980 | Boyer et al. | |
| 4,284,037 | A * | 8/1981 | Kasting et al. | 123/41.72 |
| 5,113,819 | A * | 5/1992 | Murakawa et al. | 123/198 E |
| 6,004,111 | A | 12/1999 | Miyazaki et al. | |
| 6,279,556 | B1 | 8/2001 | Busen et al. | |
| 6,505,615 | B2 | 1/2003 | Pietschner | |
| 6,832,603 | B2 | 12/2004 | Knollmayr | |
| 7,726,273 | B2 * | 6/2010 | Azevedo et al. | 123/193.2 |

(Continued)

FOREIGN PATENT DOCUMENTS

DE 1033977 7/1958

(Continued)

OTHER PUBLICATIONS

English Abstract of DE 3107191.

(Continued)

*Primary Examiner* — M. McMahon
(74) *Attorney, Agent, or Firm* — Dykema Gossett PLLC

(57) ABSTRACT

A crankcase breathing system (1) for an internal combustion engine includes at least one oil separating apparatus with a preliminary separator (3) and a main separator (4) arranged downstream of the same, with the preliminary separator (3) including a diffuser (11) between an inlet (7) and an outlet (8) which expands in the direction of flow. In order to achieve high separation rates in the simplest possible way it is provided that the preliminary separator (3) is arranged integrally with the main separator (4), with preferably the preliminary separator (3) and the main separator (4) forming a separator unit (2).

17 Claims, 10 Drawing Sheets

U.S. PATENT DOCUMENTS

| | | | | |
|---|---|---|---|---|
| 2001/0005986 | A1 | 7/2001 | Matsubara et al. | |
| 2002/0094896 | A1 | 7/2002 | Nakamura et al. | |
| 2002/0129776 | A1* | 9/2002 | Krenn | 123/41.82 R |
| 2004/0144374 | A1 | 7/2004 | Knollmayr | |
| 2007/0240670 | A1* | 10/2007 | Adams et al. | 123/193.3 |
| 2008/0314339 | A1* | 12/2008 | Koseki | 123/41.52 |
| 2009/0114173 | A1* | 5/2009 | Haubner et al. | 123/41.72 |
| 2010/0236504 | A1* | 9/2010 | Yamazaki | 123/41.72 |

FOREIGN PATENT DOCUMENTS

| | | |
|---|---|---|
| DE | 3107191 | 6/1982 |
| DE | 270117 | 7/1989 |
| DE | 19642218 | 4/1998 |
| DE | 20103652 | 8/2002 |
| DE | 10312190 | 10/2003 |
| EP | 0100756 | 2/1984 |
| EP | 1407807 | 4/2004 |
| EP | 1563909 | 8/2005 |
| FR | 2332424 | 6/1977 |
| JP | 9144524 | 6/1997 |
| JP | 9303129 | 11/1997 |

OTHER PUBLICATIONS

English Abstract of DE 10312190.
English Abstract of JP9303129.
English Abstract of EP1563909.
English Abstract of JP9144524.
English Abstract of EP1407807.
English Abstract of DE19642218.

* cited by examiner 4
2
15
P
16
VII
VII
3

2
15a
12
5
8
4
13
11
3
α
D1
D2
16
7
F
P
11a
5a
10
6
6a
14

16
5
3
2
15a
10
6
4
14

3
15a
13
12
8
4
16
P
7
6
10
6a
14

2
16
6
X
4
X
15a
5
3

CRANKCASE BREATHING SYSTEM

BACKGROUND OF THE INVENTION

1. Field of the Invention

The invention relates to a crankcase breathing system for an internal combustion engine, comprising at least one oil separating apparatus with a preliminary separator and a main separator arranged downstream of the same, with the preliminary separator comprising a diffuser between an inlet and an outlet which expands in the direction of flow. The invention further relates to a liquid-cooled internal combustion engine with a crankcase for several cylinders with a cooling jacket about the cylinders in the crankcase, with individual cylinder heads with at least two cooling chambers arranged above one another in the cylinder head, with the cooling jacket of the crankcase and the bottom cooling chamber in the cylinder head being connected with each other via at least one, preferably at least four, transfer openings which are evenly distributed on the circumference of the cylinder. The invention also relates to a multi-part pulley, especially a poly-V pulley. The invention further also relates to an internal combustion engine with an oil pump whose feed pressure can be limited by a control valve, with the control valve having a spring-loaded control piston which is displaceable in the control cylinder, and with a gradual-removal chamber formed by control piston and control cylinder being connected with an oil return line.

2. The Prior Art

An oil preliminary separator is known from AT 006.652 U1 which can be provided upstream of a main oil separator in a crankcase breathing system. The preliminary separator comprises a diffuser between inlet and outlet which expands in the direction of flow. High separation rates can thus be achieved.

DE 31 07 191 A1 describes a crankcase breathing system for an internal combustion engine, comprising a funnel-like liquid separator which comprises a separator packing and an upwardly facing screen. An annular collecting chamber for separated liquid is arranged in the area of the transition to a downwardly arranged breathing line. The lowest point of the annular collecting chamber is the starting point for a liquid discharge line which is arranged in the interior of the breathing line, reaches back up to the crankcase and is guided here into a steadied-flow zone.

FR 2 332 424 A discloses an oil separator for an internal combustion engine which comprises a double cone between the inlet and outlet, which double cone expands in a first section in a diffuser-like way. This is then followed by a funnel-like section in which the cross section tapers until the discharge from the oil separator. A number of baffle plates is arranged in the oil separator which improve the separation of the oil. The entrainment of especially small oil drops still cannot be prevented in the case of especially high flow quantities.

A cylinder head for several cylinders for a liquid-cooled internal combustion engine is known from AT 005.301 U1, comprising a cooling chamber arrangement adjacent to a fire deck which is subdivided into a fire-deck-side bottom partial cooling chamber and an upper partial cooling chamber adjacent thereto in the direction of the cylinder axis by an intermediate deck extending substantially parallel to the fire deck. The bottom and upper partial cooling chamber are flow-connected with each other via an annular overflow opening about an injection device. The coolant reaches the bottom partial cooling chamber through at least one inlet bore per cylinder arranged in the fire deck, flows through the same in the transversal direction and reaches the upper partial cooling chamber through the annular overflow opening.

DE 103 12 190 A1 discloses a crankcase with wet liners which are enclosed by cooling chambers. The cooling chambers are in connection with a distributor duct arranged in the area of a longitudinal side wall of the crankcase, above which a collecting duct is arranged.

Poly-V belts are especially suitable for transmitting drive and tension forces at high belt speeds and minute disk diameters and have especially favorable running and transmission properties. Highly flexible poly-V belts are described in DD 270 117 A1 for example.

Furthermore, a drive device for an auxiliary machine unit with a driven poly-V pulley is known from DE 102 00 686 A1.

As a result of the small dimensioned poly-V belt application surfaces, poly-V belts are more sensitive to dirt, rust and porous frictional surfaces in the grooves than known narrow V-belts. Poly-V pulleys therefore must offer high surface quality in the area of the belt application surfaces. Especially in the case of poly-V belt disks arranged in several steps, a considerable production effort is required for achieving high surface quality.

Multi-part pulleys for simple belts are known from EP 0 100 756 A1 or U.S. Pat. No. 4,193,310 A. The pulley consists of two mutually connected disk holding parts, with the receiving surfaces for the belts being formed by both disk holding parts.

EP 0 875 678 A2 discloses an oil pump with a control valve, with the control valve comprising a control piston displaceable in a cylinder. The control pressure is formed by the pump pressure applied directly onto the pressure side of the pump. The oil is supplied to a main intake opening or an ancillary intake opening of the pump depending on the pump pressure.

In the case of oil pumps with gradual removal into the suction chamber, the desired oil pressure in the main oil duct is achieved in that the spring of the control valve in the oil pump is set higher by the flow resistances of the downstream oil cooler and oil filter. The disadvantageous aspect is that especially in the case of cold starting the oil pressure build-up is delayed.

It is the object of the invention to avoid these disadvantages and to achieve optimal oil separation with the lowest possible effort in all operating ranges of the internal combustion engine. It is a further object to achieve an optimal and even cooling of thermally critical areas. It is also an object of the invention to provide a pulley that can be produced in a cost-effective way. It is further an object of the invention to enable rapid oil pressure build-up especially during cold starting.

SUMMARY OF THE INVENTION

It is provided according to the invention that the preliminary separator is arranged integrally with the main separator, with preferably the preliminary separator and the main separator forming a separator unit. An especially cost-effective production can be enabled by the integral arrangement.

Especially high separation rates are achieved when the main separator is formed by a cyclone separator, preferably a multi-cyclone separator, with the outlet of the preliminary separator being arranged in a tangential way relative to the main separator. Moreover, the oil separation in the preliminary separator can be improved substantially when at least one baffle plate is arranged between the inlet and the outlet of the preliminary separator, with preferably the baffle plate having a shape which is round, elliptical, rectangular, square or composed of arcs of a circle.

It is provided within the framework of the invention that the baffle plate is spaced from the outlet of the preliminary separator, with the distance between the baffle plate and the outlet being determined depending on the maximum quantity of blow-by gas and with the distance being arranged smaller with increasing quantity of blow-by gas.

It is preferably provided that an outlet opening for the separated oil is arranged in the area of the largest cross section of the diffuser and at the lowest point of the housing. The diffuser leads to a reduction in the speed which prevents an entrainment of the oil film. The oil of the wall film flows as a result of gravity to the lowest point where the outlet opening is placed. A portion of the fine particles in the blow-by gas collects on the baffle plate into larger drops and they then fall onto the conical jacket surface of the diffuser and flow further to the outlet opening.

Especially good oil separation rates can be achieved when a substantially annular inlet part is arranged in the area of the outlet for the blow-by gas, which inlet part protrudes into the interior of the housing, preferably in the area of the largest cross section of the diffuser.

A very compact arrangement of the preliminary separator can be achieved when inlet, outlet, diffuser and/or inlet part are provided with a rotationally symmetrical configuration, wherein preferably the inlet, outlet, diffuser and/or inlet part can be arranged coaxially. It is also possible to arrange inlet, outlet, diffuser and/or inlet part in an offset manner relative to each other. As an alternative to a rotationally symmetrical shape, the preliminary separator can also be arranged as a truncated pyramid with an elliptical, square, rectangular or polygonal cross section.

The preliminary separator is especially suitable for installation with horizontally arranged longitudinal axis.

Especially favorable results can be achieved when the diffuser has an opening angle of not more than 30°, preferably between 10° and 20°, as measured with respect to the longitudinal axis.

It is well known that blow-by gas should be taken at the quietest possible location of the internal combustion engine, far from producers of oil mist and oil splashes. The lines should be dimensioned as large as possible in order to avoid high gas flow velocities and to prevent the entrainment of larger oil drops. These requirements cannot always be fulfilled, so that too small removal points in the cross section cannot be avoided. In order to prevent the entrainment of larger oil drops, it is provided within the scope of the invention that the preliminary separator is provided upstream with a calming chamber, with one, preferably at least two, crankcase breathing lines connected with the crank chamber opening into the calming chamber. Several withdrawal lines of smaller diameter can open into said calming chamber. It is further possible that a breathing line connected with the outlet of the main separator crosses the calming chamber.

It is preferably provided that the calming chamber comprises an oil return connection at its lowest point. The oil returns of the preliminary separator, the main separator and optionally also the calming chamber can open into a common oil return line.

The collected oil can be guided back to the oil pan, especially beneath the oil level, by suitable shaping. A return to the crankcase is also possible by using non-return valves.

In order to achieve optimal and even cooling of thermally critical areas, it is provided that the inlet distributor chamber is connected with the cooling jacket of the crankcase for a preferably dry liner via at least one connecting duct per cylinder, with preferably each connecting duct, when seen in a plan view, opening in a substantially radial manner into the cooling jacket with respect to the cylinder. The radial inflow is highly relevant in order to achieve even cooling of the cylinders.

It is further advantageous for even cooling when the connecting duct is arranged between a main oil duct and a return duct connecting the cooling chambers of the cylinder head with the return collecting chamber.

It is preferably provided that the inlet distributor chamber and/or return collecting chamber are arranged integrally with the crankcase, with preferably the inlet distributor chamber and/or the return collecting chamber extending over all cylinders arranged in a row. The number of parts and the sealing surfaces can thus be minimized and the coolant can be distributed among all cylinders evenly. This may be supported on a case by case basis by changes in the cross section of the individual inlets.

In order to reduce noise emissions of the crankcase to the ambient environment it is advantageous when the outside wall of the crankcase is curved in a convex manner to the outside in the area of the inlet distributor chamber and/or the return collecting chamber, with preferably the inlet distributor chamber and/or the return collecting chamber having a substantially semicircular cross section.

It is provided in an advantageous embodiment of the invention in which both the inlet distributor chamber and the return collecting chamber are arranged in the crankcase that the return collecting chamber is arranged above the inlet distributor chamber. In order to achieve optimal flow in thermally critical regions of the crankcase and inflow into the cylinder head it is advantageous when the inlet distributor chamber is connected via at least one connecting duct with the water jacket of the crankcase, with the inlet opening of the connecting duct from the inlet distributor chamber being arranged lower for each cylinder in the installed position of the internal combustion engine than the outlet opening into the cooling jacket. The coolant enters from the inlet distributor chamber via the distributor duct facing upwardly inclined into the cooling jacket. When seen in a plan view, said distributor duct faces radially to the cylinder. Intense cross-flow cooling shall thus be achieved in the upper hot region of the cylinder.

In order to achieve optimal cooling of the fire deck of the cylinder head, it is especially advantageous when an intermediate deck is arranged in the cylinder head between the bottom and the top cooling chamber, with the deck surface of the bottom cooling chamber formed by the intermediate deck being lowered in at least one region in such way that the coolant flow is deflected in the direction of the fire deck. As a result of the deck surface curved downwardly in a convex manner, the coolant is deflected in the direction of the fire deck. An efficient cooling can thus also be achieved between the individual intake and exhaust ports, especially between the valve reinforcing ribs.

In a further embodiment of the invention it is provided that in the area of a centrally arranged injector at least one transfer opening is arranged between the bottom and the upper cooling chamber, with the transfer opening preferably being formed by an annular gap at least in sections between the intermediate deck and an injector sleeve. The coolant transfers into the upper cooling chamber of the cylinder head around the centrally arranged nozzle holder. The central arrangement of the transfer leads in combination with the position of the four transfers to a highly efficient cooling even between the individual ducts.

The coolant flows out again from the upper water chamber of the cylinder head through a vertically aligned rectangular or triangular opening adjacent to the exhaust port via the tappet chamber in which pressed-in pipes seal off towards the push rods into the return duct in the crankcase.

It can further be provided that an oil cooler is arranged upstream of the inlet distributor chamber in the cooling circulation, with preferably the longitudinal axis of the oil cooler being arranged in an inclined manner relative to the cylinder head sealing plane at a longitudinal side of the crankcase.

In a further embodiment of the invention it can be provided that at least one cast slug is arranged on the coolant discharge side of the oil cooler and that an inlet into the inlet distributor chamber is curved in a convex manner at the bottom end of the oil cooler chamber.

A cost-effective pulley can be produced when the pulley consists of a belt part which is preferably arranged as a hollow cylinder and a hub part which is torsionally rigidly connected with the same, with the hub part being arranged at least partly within the belt part. A durable rotational connection that is easy to produce is achieved when the hub part and the belt part are connected with each other by a pressed joint and/or a shrink joint.

It is preferably provided that the belt part is made of steel and that the hub part consists of a casting material. Belt receiving surfaces with high surface quality can be produced in a cost-effective way by the division of material between belt part and hub part. The pulley which consists of forged steel ensures that the belt receiving surface can be kept pore-free. The hub part can consist of a casting material which enables cost-effective production despite more complex shaping.

In a preferred embodiment it is provided that the belt part is provided with a stepped arrangement and comprises at least two belt receiving surfaces with different diameters.

It is especially advantageous when a vibration damper is rotationally connected with the hub part. In order to achieve sufficient cooling for the vibration damper, it can be provided with ventilating elements. It is further advantageous for improving cooling of the vibration damper when the hub part comprises at least one axial flow opening for cooling air. The coolant reaches the vibration damper via the flow openings in the hub part and flows supported by the ventilating elements between pulley and vibration damper radially to the outside, with the surface of the vibration damper being cooled.

In order to achieve a rapid oil pressure progression during cold starting it is advantageous when a control line which opens into the control chamber and is supplied with the control pressure is connected with the main oil duct of the internal combustion engine. The control pressure line preferably branches off from the lubricating oil system downstream of the oil cooler and/or the oil filter. A return line which is connected with the return opening preferably leads to an oil collecting chamber, with the opening of the return line being arranged beneath the oil level. In this way, oil foaming during the gradual removal of the quantity of lubricating oil not required by the internal combustion engine can be avoided. It is provided that one of the removal openings of the control valve is connected with a pressure duct of the pump.

In addition to the control valve, it is possible to provide a pump safety valve which is set to a considerably higher removal pressure.

The oil not required is guided in a purposeful manner to the oil pan close to the intake point, preferably via a return duct formed by a bent pipe.

The control valve and/or the pump safety valve may be integrated in the housing of the pump.

The invention will now be explained in greater detail by reference to the attached drawings.

DETAILED DESCRIPTION OF THE EMBODIMENTS

Figure 1:
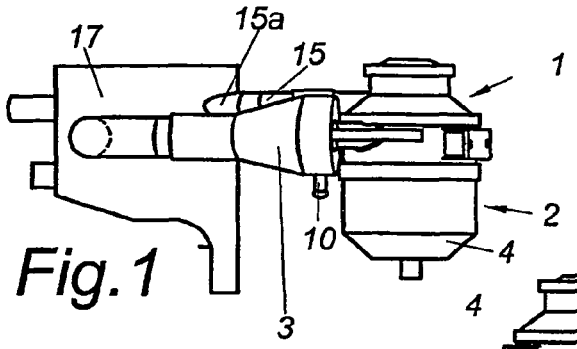
FIG. 1 shows a crankcase breathing system in accordance with the invention in a first view.

Parts with the same function are provided with the same reference numeral.

Figure 2:
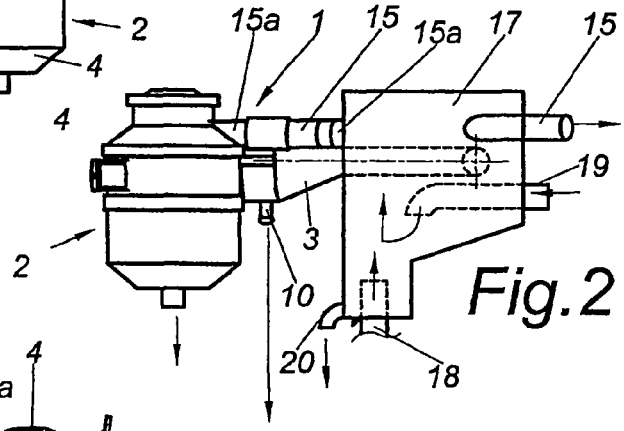
FIG. 2 shows the crankcase breathing system in a second view.
Figure 3:
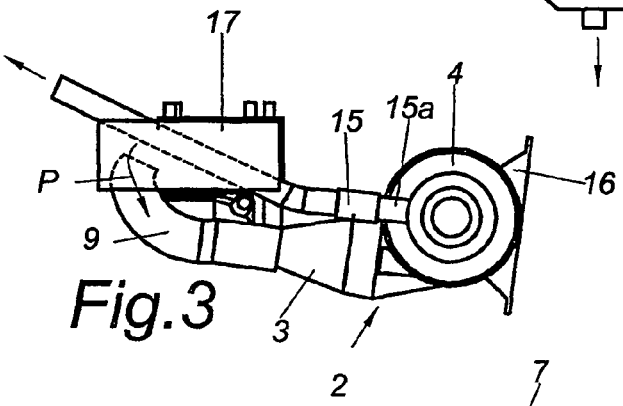
FIG. 3 shows the crankcase breathing system in a top view.

The crankcase breathing system 1 as shown in FIGS. 1 to 3 comprises a separator unit 2 which consists of a preliminary separator 3 and a main separator 4. The separator unit 2 is shown in detail in FIGS. 4 to 7. The housing 5 of the preliminary separator 3 and the housing 6 of the main separator 4 are arranged integrally, which thus allows cost-effective production. The main separator 4 can be arranged as a cyclone separator with integrated nonwoven separator and with a pressure control valve provided upstream of the gas outlet.

Furthermore, the main separator 4 can also be arranged as a multi-cyclone separator or as an electric system.

The preliminary separator 3 comprises an inlet 7 for a crankcase breathing line 9 and an outlet 8 which opens tangentially into the main separator 4. An outlet opening 10 is arranged at the lowest point of housing 5 of preliminary separator 3, to which opening an oil return line can be connected (not shown in closer detail). Housing 5 is arranged as a diffuser 11 opening in the direction of flow P between the inlet 7 and the outlet 8. The opening angle $\alpha$ opened between diffuser 11 and the longitudinal axis 5*a* of housing 5 is approximately between 5° and 30°, and approximately 15° in the embodiment.

Outlet 8 has a tubular inlet part 12 which protrudes into the interior of housing 5 and is arranged approximately in the region of the largest cross section of diffuser 11.

Figure 7:
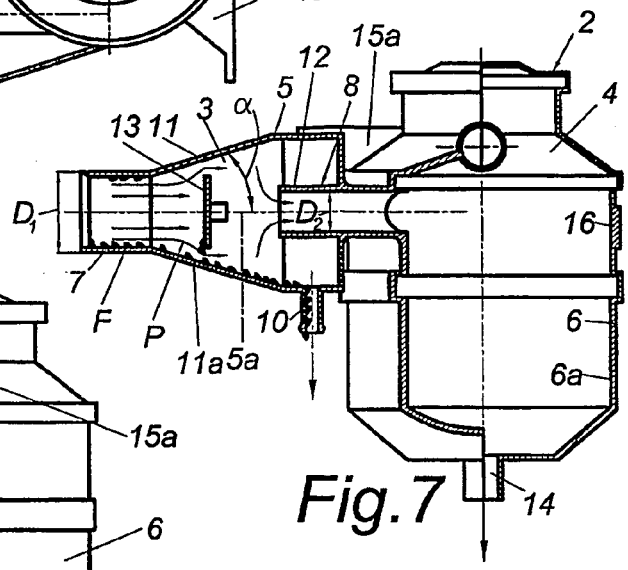
FIG. 7 shows the separator unit in a sectional view along line VII-VII in FIG. 6.

As is indicated with arrows P in FIG. 7, the crankcase breathing flow reaches diffuser 11 through inlet 7 and leaves the same again through outlet 8. A baffle plate 13 is arranged between inlet 7 and outlet 8 in order to improve the degree of separation. Baffle plate 13 can have a shape which is round, elliptical, rectangular, square or composed of arcs of a circle and can be adjusted in its longitudinal position to the needs of the engine.

Inlet 7 has a larger diameter D1 than the outlet 8 whose diameter is designated with reference numeral D2. As a result of the pressure drop caused by the diffuser 11, oil droplets will form on the walls 11*a* of diffuser 11 and form an oil wall film, as indicated by reference numeral F. Diffuser 11 leads to a reduction in speed which prevents any entrainment of the oil wall film F. The oil of the oil wall film F flows to the lowest point as a result of gravity where the outlet opening 10 is positioned. A portion of the fine particles in the blow-by gas collects on the baffle plate 13 into larger drops. They then fall onto the conical jacket surface of diffuser 11 and then continue to flow further towards the outlet opening 10. The oil leaves housing 5 via the outlet opening 10 in order to be supplied again to the lubrication circulation of the internal combustion engine. The blow-by gases then further reach the main separator 4 through the outlet 8, with a swirling motion being produced by the tangential inlet. As a result of the inertia of masses, the oil droplets are separated on the walls 6*a* of housing 6 and leave the main separator 4 via the oil return connection 14 which is arranged at the lowest point of housing 6. The blow-by gases leave housing 6 via a gas outlet 15*a* arranged in the upper region of housing 6 and a breathing line 15 connected to the same. The gas outlet 15*a* can also be provided upstream with a pressure control valve (for positive or negative crankcase pressure).

Figure 4:
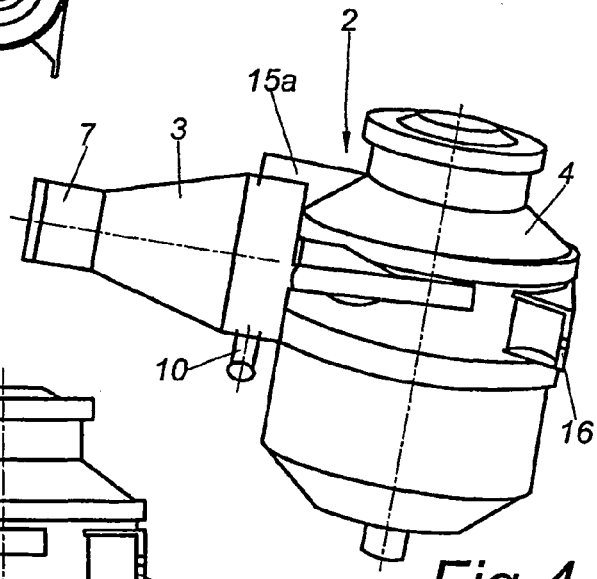
FIG. 4 shows a separator unit of the crankcase breathing system in accordance with the invention in an oblique view in a first embodiment.
Figure 5:
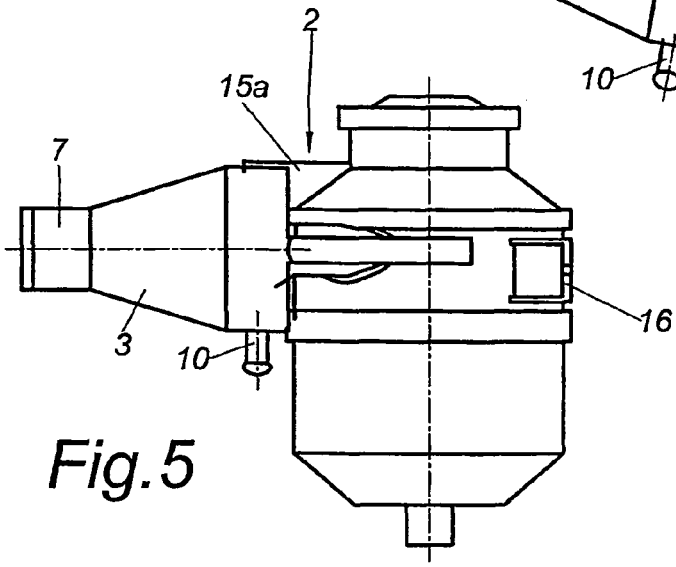
FIG. 5 shows the separator unit in a side view.
Figure 6:
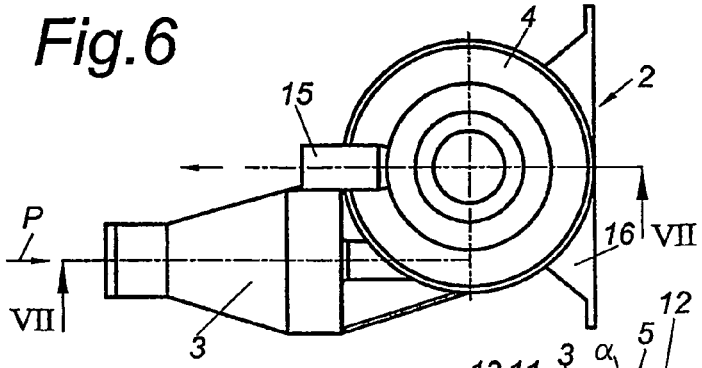
FIG. 6 shows the separator unit in a top view.

In the embodiment shown in FIGS. 4 to 6, the main separator 4 comprises fastening elements 16 with which the crankcase breathing system can be fastened to the machine housing.

Figure 8:
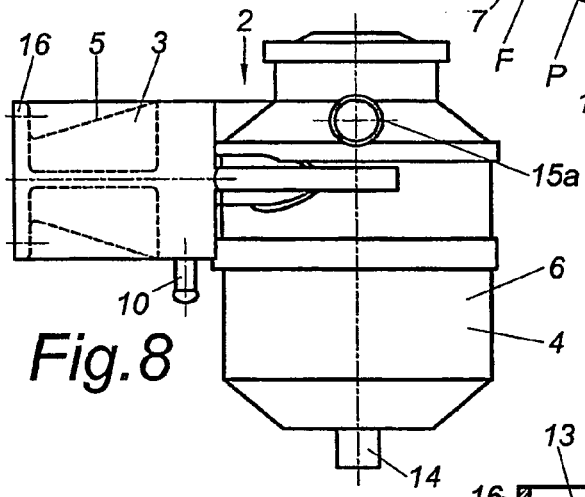
FIG. 8 shows a separator unit of a crankcase breathing system according to the invention in a second embodiment in a side view.
Figure 10:
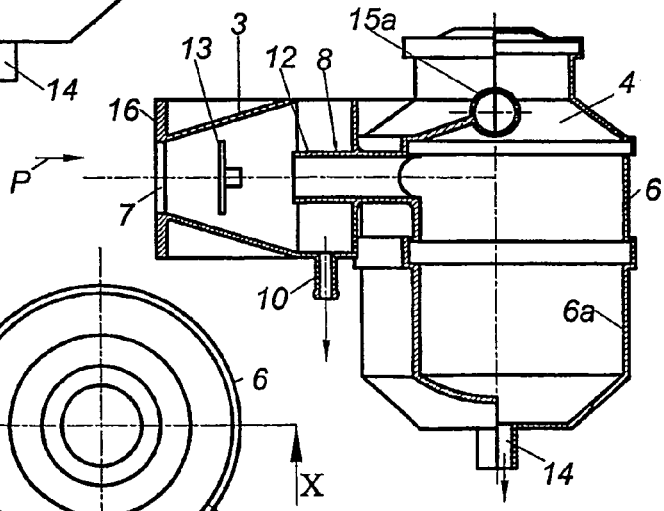
FIG. 10 shows the separator unit in a sectional view along line X-X in FIG. 9.
Figure 9:
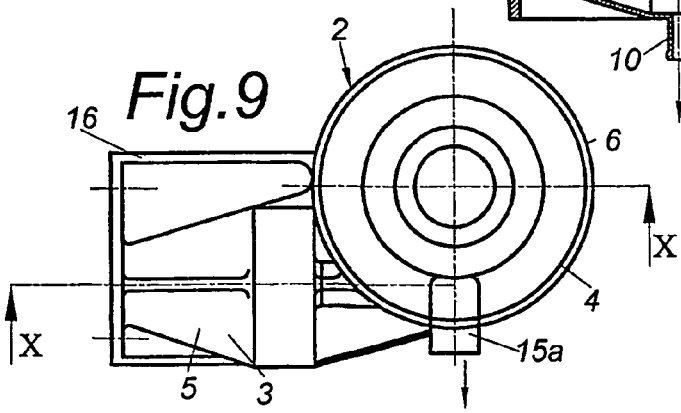
FIG. 9 shows this separator unit in a top view.

The embodiment shown in FIGS. 8 to 10 differs from the embodiment described above in such a way that the preliminary separator 3 is provided with fastening elements instead of the main separator 4. The remaining description of FIGS. 4 to 7 applies to this embodiment as well.

In addition to the separator unit 2, a calming chamber 17 can be provided, as is shown in FIGS. 1 to 3. Calming chamber 17 prevents that larger oil drops will reach the separator unit 2. Several crankcase breathing lines 18, 19 of smaller diameter can open into the calming chamber 17, which breathing lines will remove blow-by gases from the crankcase. In the illustrated example, the breathing line 15 originating from the main separator 4 crosses the calming chamber 17 for constructional reasons.

Calming chamber 17 comprises an oil return connection 20 at its lowest point, through which the collected oil can be supplied to the oil pan again beneath the oil level. As an alternative to this, the entire oil can also be returned via non-return valves to the crankcase or into the front crank cover for example.

The oil return lines of preliminary separator 3 and the main separator 4 can be combined into a common oil return duct which opens into the oil pan or, via non-return valves, into the crankcase.

The described crankcase separating system allows for especially high separation rates with minimal constructional and structural effort.

Figure 11:
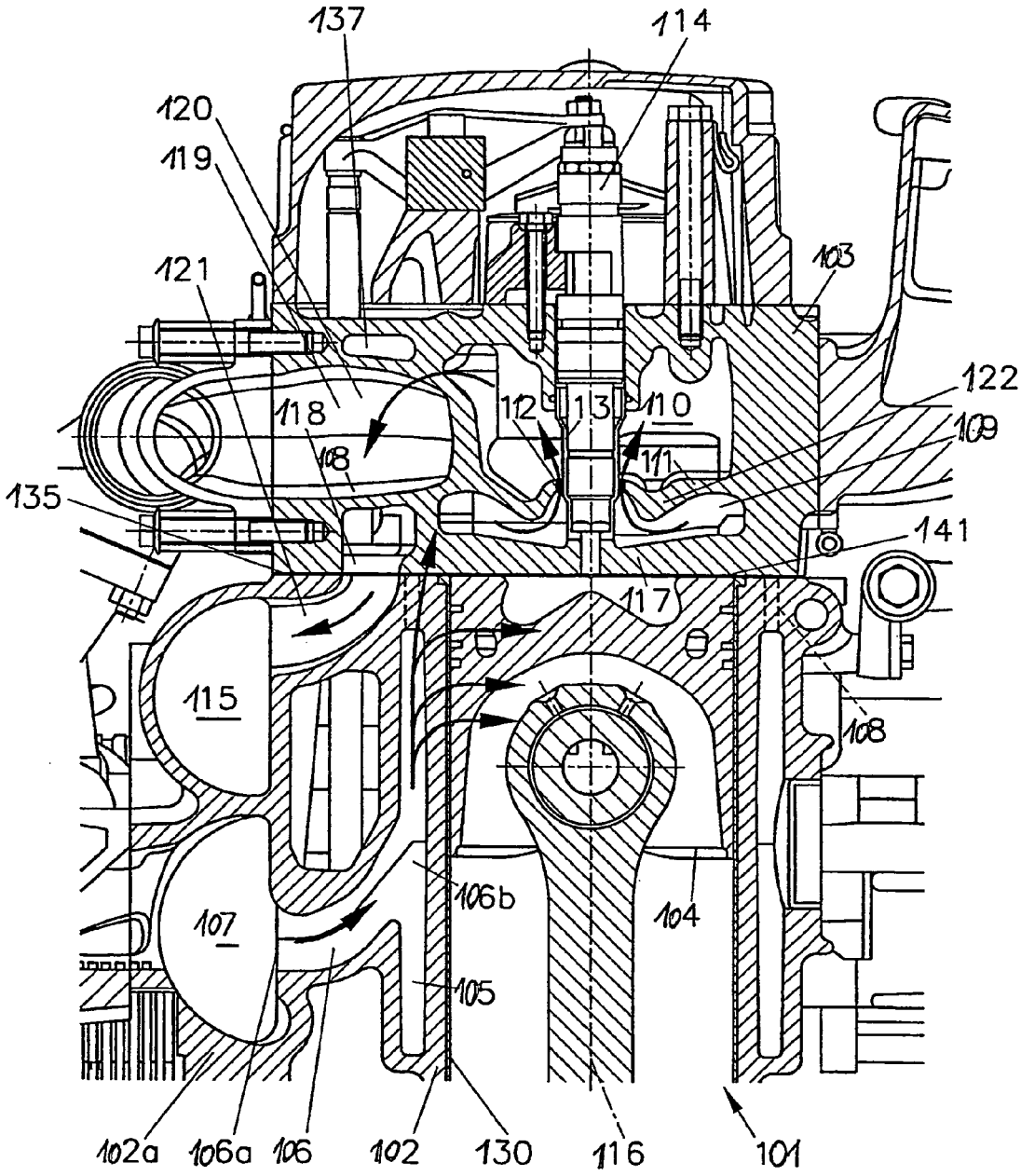
FIG. 11 shows an internal combustion engine in a cross-sectional view.

FIG. 11 shows an internal combustion engine 101 in accordance with the invention with a crankcase 102 and a cylinder head 103 in a cross-sectional view normal to the crankshaft axis (not shown).

A reciprocating piston 104 is arranged in a cylinder 130. Cylinder 130 is enclosed by a cooling jacket 105. Cooling jacket 105 is in connection with an inlet distributor chamber 107 via a connecting duct 106, which distributor chamber is positioned above a main oil duct 140. An oil cooler is arranged upstream of the inlet distributor chamber 107 in the coolant circulation between a coolant pump (not shown) and the inlet distributor chamber 107.

Cooling jacket 105 is in connection with cooling chambers 109, 110 of the individual cylinder head 103 via transfer openings 108 in the cylinder sealing plane 135. A bottom cooling chamber 109 is separated from the upper cooling chamber 110 via an intermediate deck 111. The bottom and upper cooling chamber 109, 110 are mutually connected via an annular transfer opening 112 for example between intermediate deck 111 and an injector sleeve 113 for receiving an injector 114. The ring form of the transfer opening 112 can be interrupted by casting expansions. Other forms of transfer openings 112 are possible. The upper cooling chamber 110 is in connection with the push rod chamber 137 via the transfer opening 131. The cooling medium exits beneath the outlet duct 120 via the outlet opening 118 from the cylinder head 103 and through a similarly shaped opening in the cylinder head gasket 141 into the crankcase 102. The cooling medium is guided via the individually bent return ducts 121 into the longitudinally extending return collecting chamber 115. The return collecting chamber 115 is connected with the intake side of the water side (not shown in closer detail) via coolant lines in which the thermostat valve and cooler are arranged. The inlet distributor chamber 107 and the return collecting chamber 115 are arranged in an integral way with the crankcase 102 and are arranged in the region of a side wall 102*a* of the crankcase 102.

After exiting from a coil of the water pump (not shown in greater detail), the coolant is guided via an intermediate housing to an inflow or distributor chamber 134 before an oil cooler 127 arranged inclined in the crankcase 102, which oil cooler is arranged on the outside in the region of the side wall 102*a* of the crankcase 102. Reference numeral 127 indicates the oil cooler. Reference numeral 128 designates the flange for an oil cooler cover. An even flow through the individual oil cooler fins is achieved by the inclined arrangement of the oil cooler 127 and the inclined oil cooler chamber 129, with flow shadows being prevented to a substantial extent. Since a number of oil-guiding cast slugs 123 of the oil guide means of the oil cooler bypass valve are arranged on the coolant discharge side 133 of the oil cooler chamber 129, the inlet 132 in the area of the coolant discharge side 133 is curved in an arc-shaped manner towards the rear end of the inlet distributor chamber 107.

Figure 12:
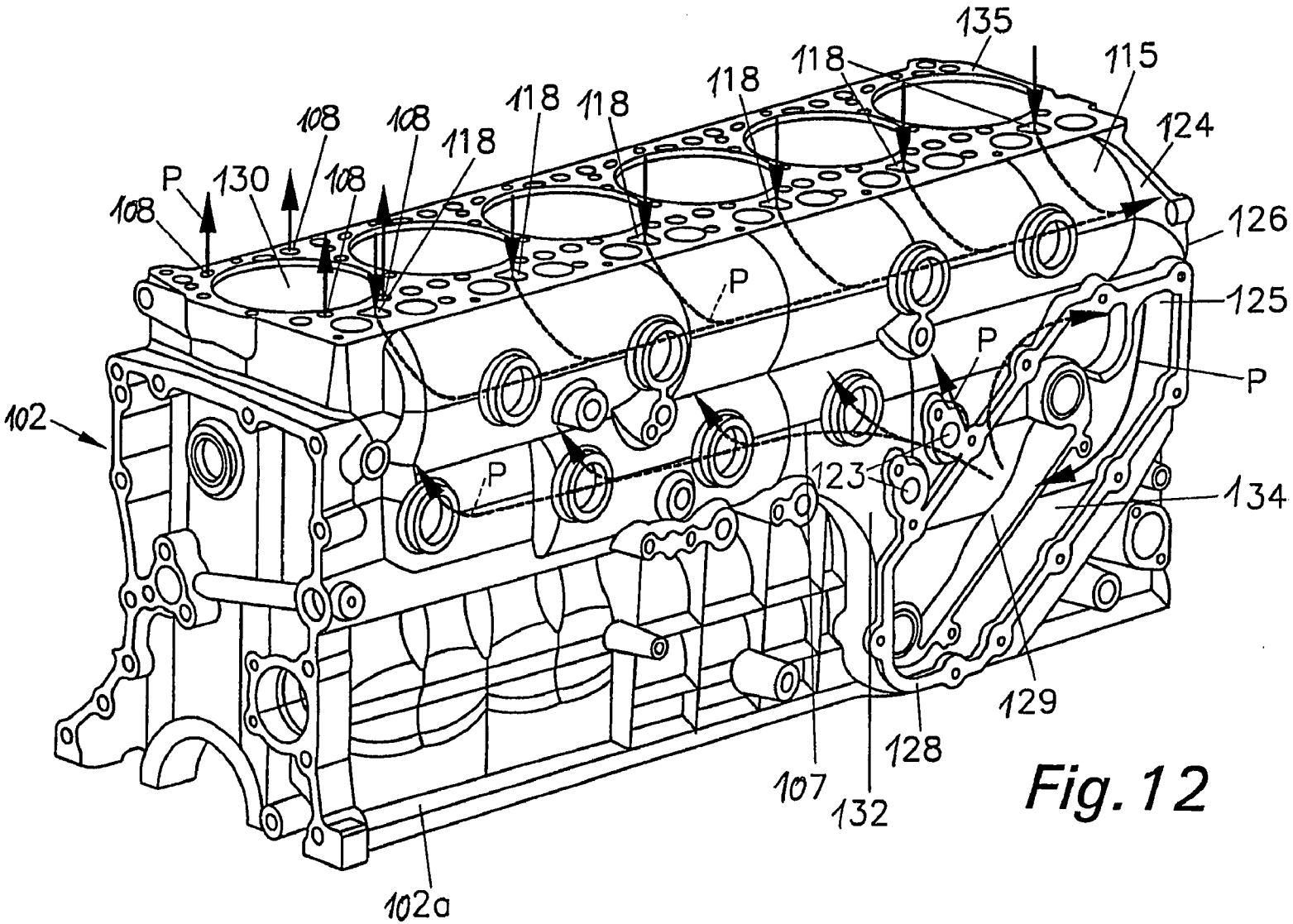
FIG. 12 shows a crankcase of this internal combustion engine in an oblique view.
Figure 13:
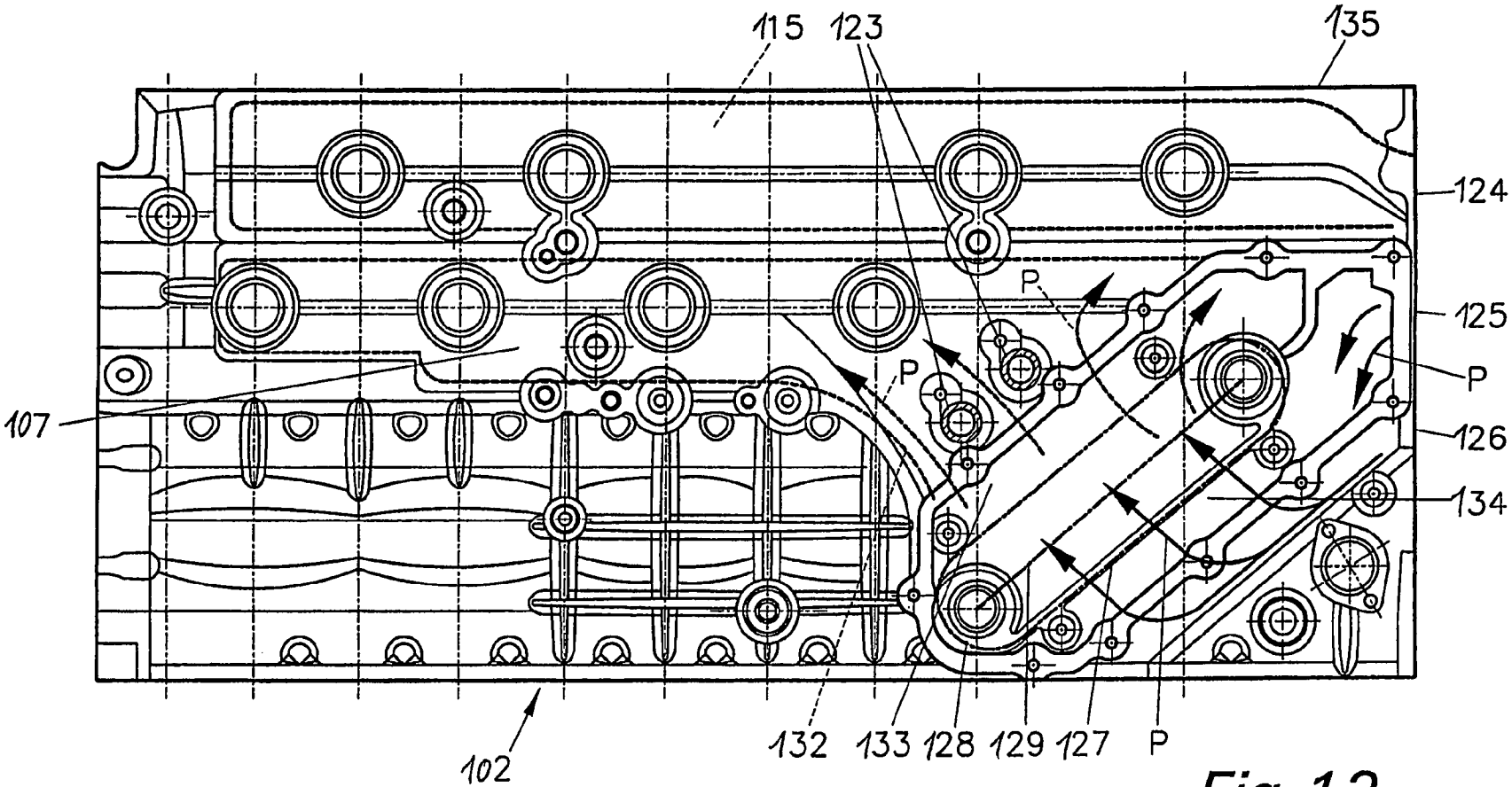
FIG. 13 shows the crankcase in a side view.
Figure 14:
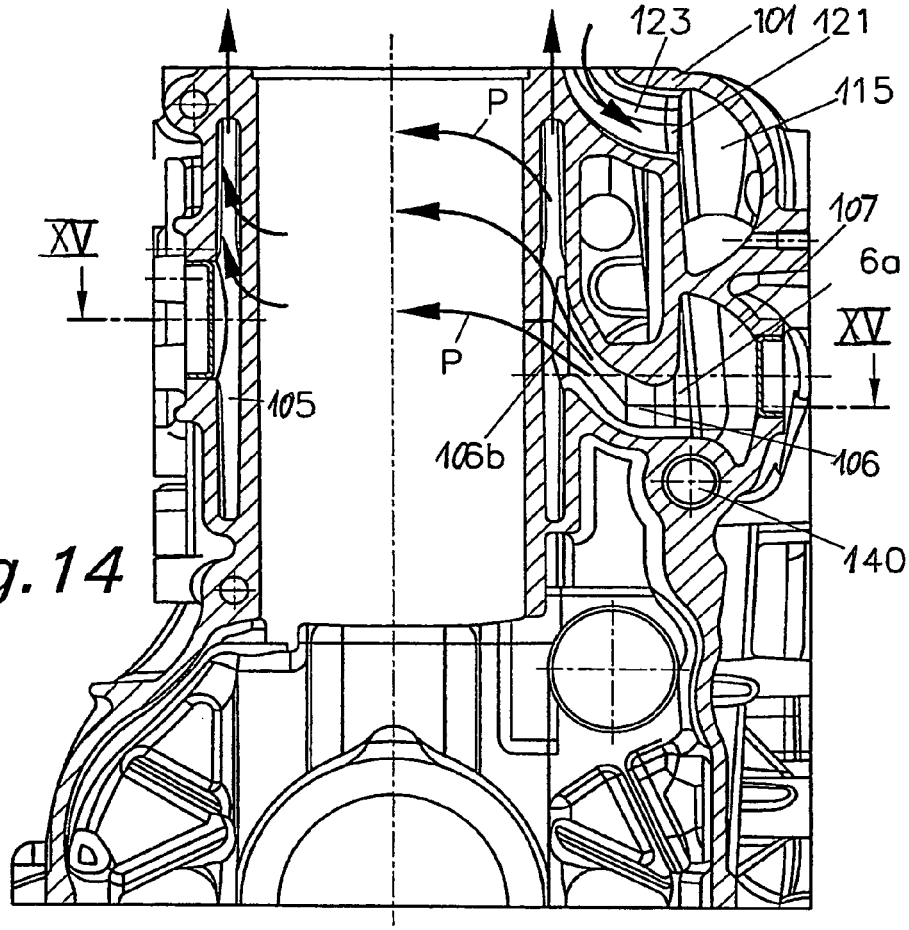
FIG. 14 shows the crankcase in a sectional view along line XIV-XIV in FIG. 15.
Figure 15:
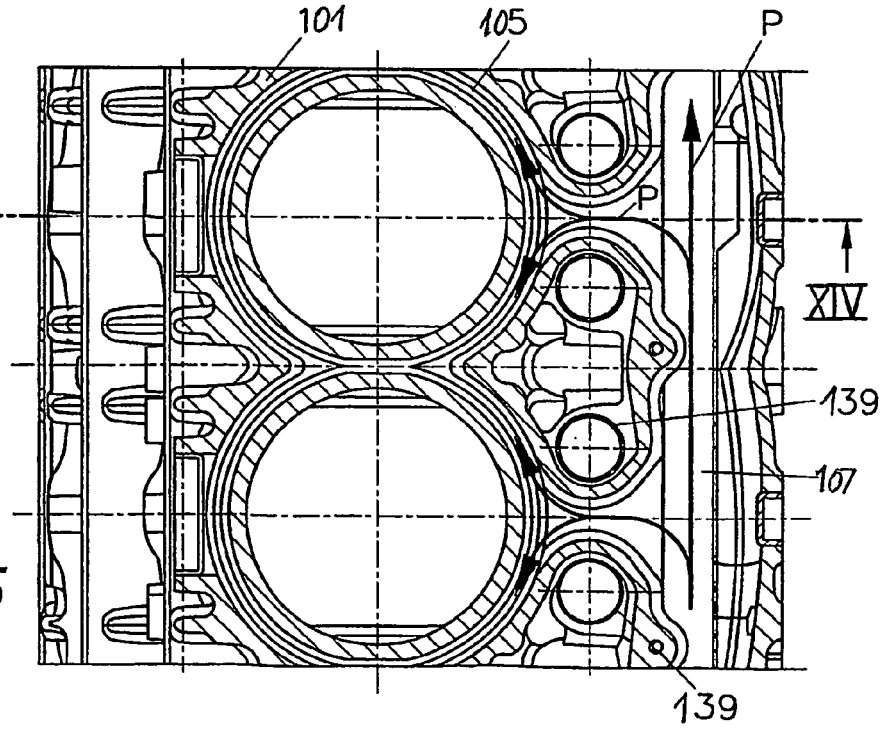
FIG. 15 shows the crankcase in a sectional view along line XV-XV in FIG. 14.
Figure 16:
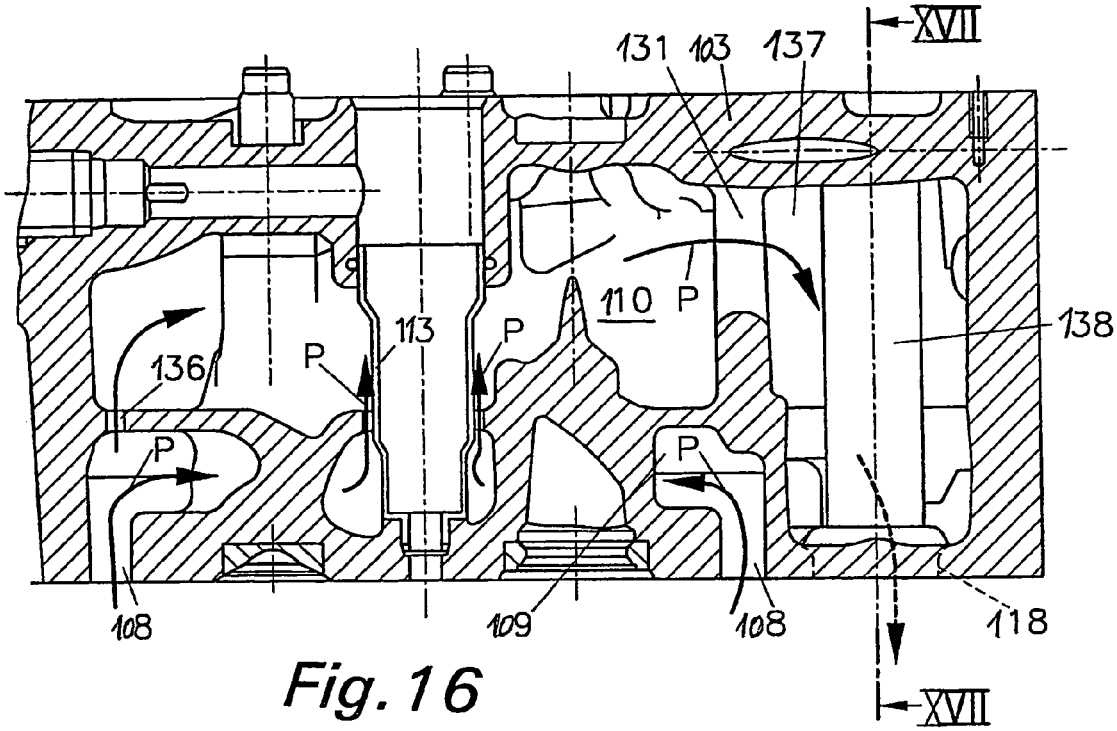
FIG. 16 shows a cylinder head in a cross-sectional view.
Figure 17:
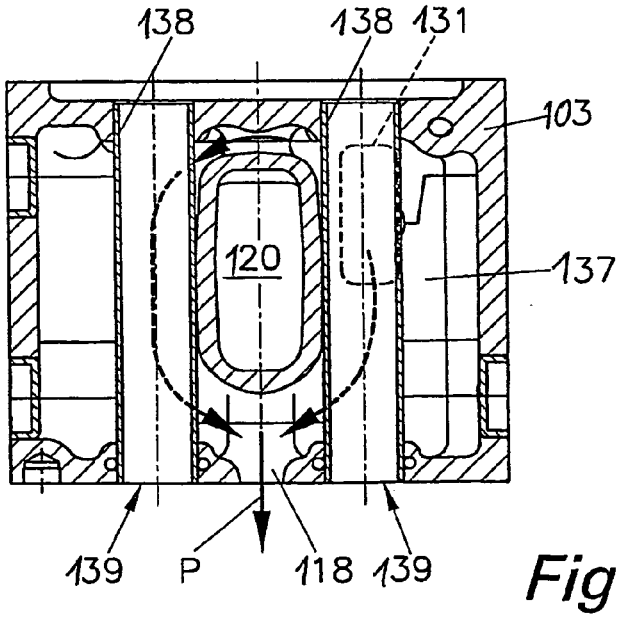
FIG. 17 shows the cylinder head in a cross-sectional view along line XVII-XVII in FIG. 16.
Figure 18:
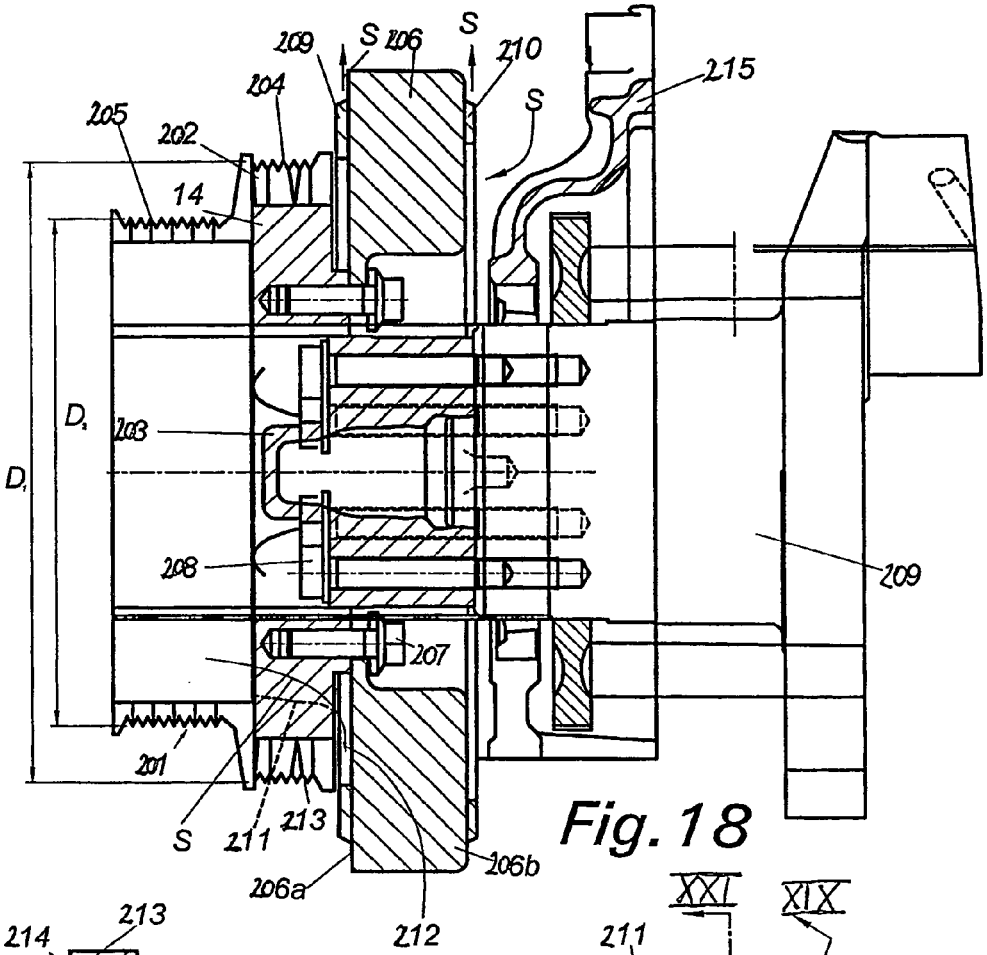
FIG. 18 shows a pulley in accordance with the invention in a longitudinal sectional view.
Figure 19:
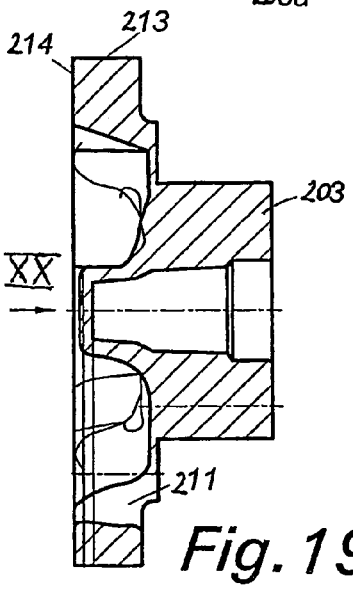
FIG. 19 shows the hub part of the pulley in a sectional view along line XXIX-XXIX in FIG. 20.

After the transversal flow of oil cooler 127, the coolant is guided into an inlet distributor chamber 107 arranged alongside a side wall 102*a* of the crankcase 102. The flow is indicated in FIGS. 11 to 13 by arrows P. From the inlet distributor chamber 107, the coolant liquid enters a connecting duct 106 which is arranged, in a plan view, radially to the cylinder 103, namely 90° to the crankshaft axis, and which is arranged at first in a normal plane to the cylinder axis 116 and then faces upwardly inclined in the direction of the cylinder axis 116. The entrance opening 106*a* of the connecting duct 106 is thus arranged lower than the outlet opening 106*b*. As a result of the special shape of said connecting duct 106, an intense cross-flow cooling can be achieved in the upper hot area of cylinder 130. As a result of the radial inflow from the connecting duct 106 into the cooling jacket 105, an even distribution of the coolant on either side of the cylinder 130 is achieved, as is indicated in FIG. 15 by arrows P. Moreover, the even distribution between the first to the last cylinder 130 can be controlled in a very favorable manner by varying the inlet cross sections to the individual cooling jackets 105.

The control of the cross-flow in the upper hot part of the crankcase 103 occurs by means of differently large transfer cross sections in the region of the (in total four) transfer openings 108 into the cylinder head gasket 141. The cross section of two transfer openings 108 directly above the connecting duct 106 is smaller than the cross section of two transfer openings against the connecting duct 108. In order to avoid a dead-water zone, one of these transfers has a larger cross section. The cross sections were adjusted by means of CFD calculations (Computer Fluid Dynamics). The coolant flowing into the bottom cooling chamber 109 cools at first the hot fire deck 117. The coolant then moves to the upper cooling chamber 110 of the cylinder head 103 around the centrally arranged injector sleeve 113 and through a cooling chamber 110 of the cylinder head 103. The drilled transfer 136 is used for cooling the valve guide sleeves on the intake side which are not included in the main flow.

Together with the position of the four transfer openings 108, the central arrangement of the annular transfer openings 112 between the intermediate deck 111 and the injector sleeve 113 lead to a highly efficient cooling even between the individual intake and exhaust ports 120 and the valve reinforcing ribs.

As a result of the shape of the intermediate deck 111, which is curved downwardly in the central area 122, the coolant is deflected in the direction of the fire deck 117 in order to improve cooling in this area.

The coolant flows from the upper cooling chamber 110 through a rectangular opening 131 arranged on the outlet side 119 adjacent to the outlet duct 120 into the push rod chamber 137 and leaves the cylinder 103 through a return opening 118 arranged between the sleeves 138 of the push rod transfers 139 in the direction towards the return chamber 115 in the crankcase 102.

In the crankcase 102, a curved duct portion of the return duct 121 guides the coolant from the connecting opening 118 into the return collecting chamber 115 situated above the inlet distributor chamber 107.

The outlet opening 124 of this return collecting chamber 115 is arranged on a face side 126 of the crankcase 102 like the coolant inlet 125 into the inlet distributor chamber 107, as is shown in FIGS. 12 and 13. The coolant then reaches the thermostat housing arranged above the water pump (not shown in closer detail) via an intermediate housing (not shown in closer detail).

The multi-part pulley 201 for a poly-V belt consists of a belt part 202 and a hub part 203. The belt part 202 comprises belt receiving surfaces 204, 205 which are arranged in a stepped manner relative to each other and has different diameters $D_1$, $D_2$ for receiving two poly-V belts (not shown in closer detail). The belt part 202 and the hub part 203 are joined to each other via a pressed or shrink joint, with the hub part 203 being arranged within the belt part 202.

The belt part 202 consists of steel, as a result of which an especially high surface quality can be achieved in the area of the belt receiving surface 204, 205. The hub part 203 consists of a casting material, e.g. cast iron, for cost reasons and due to its complex shape.

Figure 20:
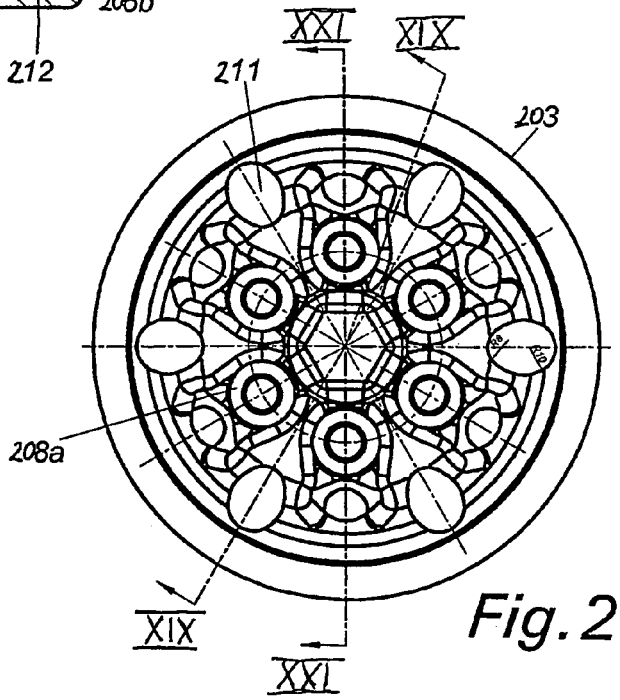
FIG. 20 shows the hub part in a side view along arrow XX in FIG. 19.
Figure 21:
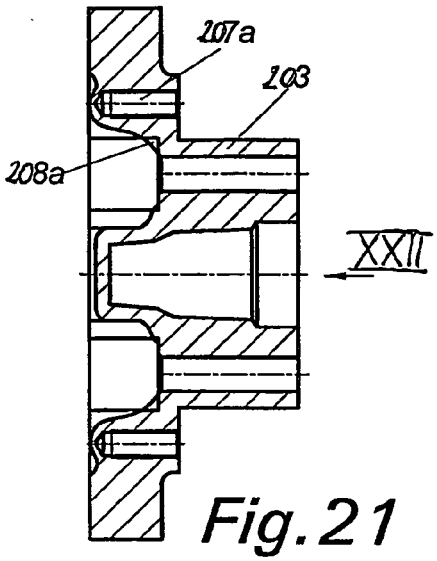
FIG. 21 shows the hub part in a sectional view along line XXI-XXI—in FIG. 20.
Figure 22:
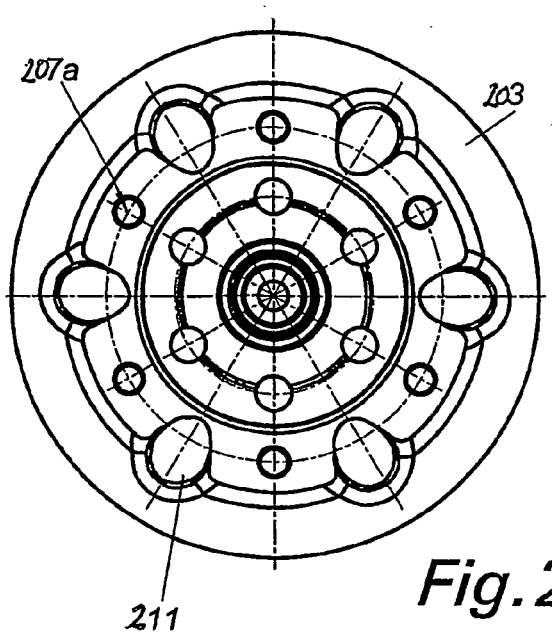
FIG. 22 shows the hub part in a side view along arrow XXII in FIG. 21.
Figure 23:
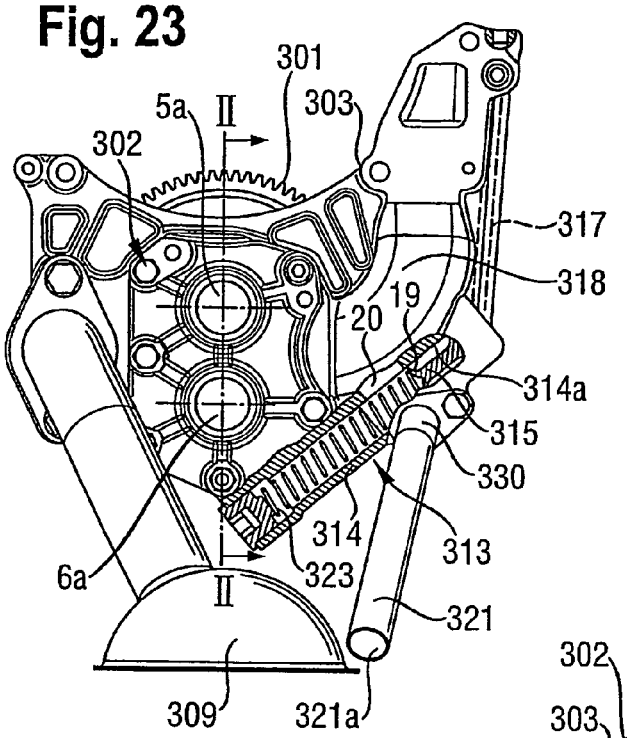
FIG. 23 shows a pump of an internal combustion engine in accordance with the invention in a side view.
Figure 24:
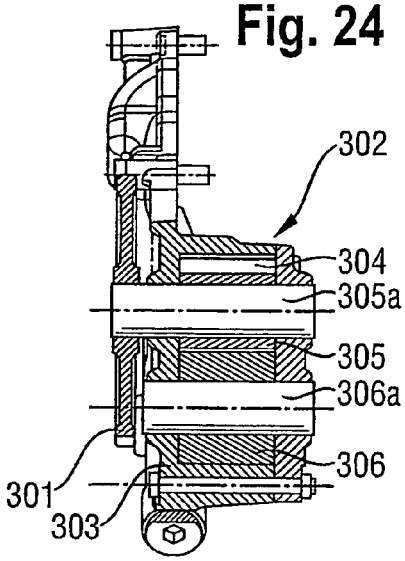
FIG. 24 shows the pump in a sectional view along line XXIV-XXIV in FIG. 23.
Figure 25:
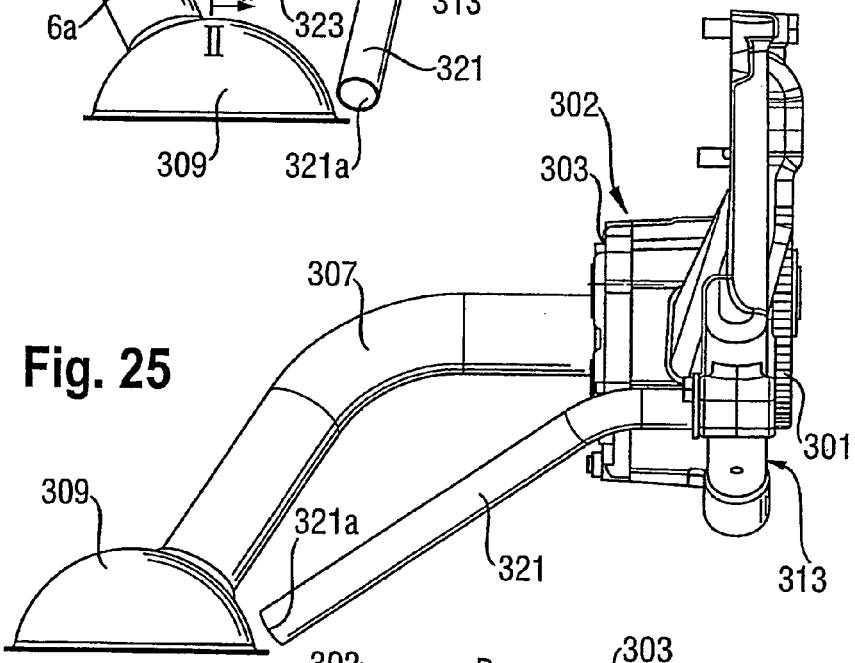
FIG. 25 shows the pump in a side view.
Figure 26:
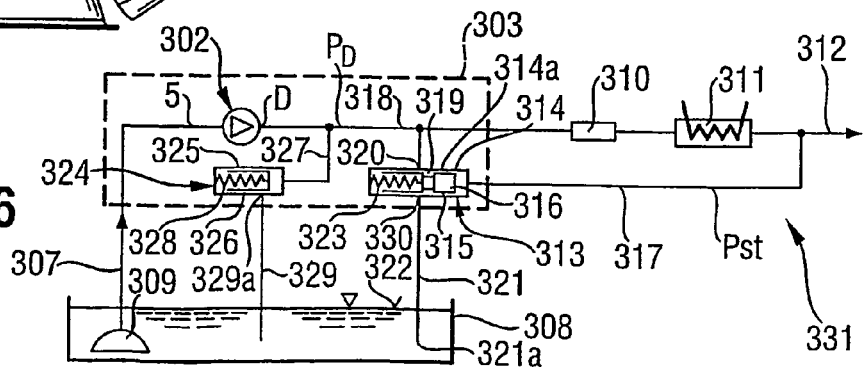
FIG. 26 schematically shows the oil circulation of the internal combustion engine in accordance with the invention.

A vibration damper 206 is fastened to hub part 203 by means of screws 207. Pulley 201 plus vibration damper 206 is rotationally connected by means of fastening screws 208 to a crankshaft 209. Reference numeral 215 relates to a crankcase receiving the crankshaft 209. The bearing surfaces for the fastening screws 208 are designated in FIG. 20 with reference numeral 208*a*. The threaded bores for the screws 207 for fastening the vibration damper 206 to hub part 203 bear the reference numeral 207*a*.

For better cooling the vibration damper 206, it comprises breathing elements in the area of its face sides 206*a*, 206*b* which are formed by fan blades 209, 210 which can be glued to the vibration damper 206 for example. Furthermore, the hub part 203 can comprise substantially axially cross-flow openings 211 for cooling air in order to improve cooling of the vibration damper 206. The cooling air flows according to arrows S axially into the pulley 201 and reaches through the cross-flow openings 211 into a gap space 212 between pulley 201 and vibration damper 206. The cooling air flows along the face surface 206*a* of the vibration damper 206, support by the fan blades 209, radially in the gap space 212 to the outside and thereby cools the surface of vibration damper 206. The fan blades 210 also cool the second face surface 206*b* of the vibration damper 206.

Belt part 202 has a bimetallic corrosion protection. The connection area 213 and the contact area 214 between belt part 202 and hub part 203 is not coated.

In comparison with a pulley forged of one part in which a large number of mechanical machining steps would be necessary as a result of the necessary die draughts, the described two-part pulley 201 leads to a substantially lower production effort.

The pump 302 which is driven by a crankshaft (not shown in detail) via a driving wheel 201 and which is arranged in the embodiment as a gear pump and belongs to a lubrication circulation 331 comprises a housing 303 with a pump chamber 304 in which conveying wheels 305, 306 are arranged which are formed by combing gearwheels. The conveying wheels 305, 306 are rotatably held in the housing 303 via shafts 305*a*, 306*a*.

Pump chamber 304 is connected via the intake side 305 of pump 302 via an intake pipe 307 with an oil collecting chamber 308 formed by an oil pan, from which lubricating oil is sucked in via an intake strainer 309. The pressure side D of pump 302 is connected via an oil filter 310 and optionally via an oil cooler 311 with an main oil duct 312.

A control valve 313 is integrated in the housing 303 of pump 302, which control valve comprises a control piston 315 displaceable in a control cylinder 314. A control line 317 opens into a control chamber 316 formed by the control cylinder 314 and the control piston 315, which control line originates from the main coil duct 312. Jacket 314*a* of cylinder 314 is further connected with the pressure duct 318 of pump 302. A control edge 319 of the control piston 315 controls an opening 302 in jacket 314*a* of control cylinder 314, which opening is connected with the pressure duct 318, as a result of which the flow connection to a return line 321 is released which opens into the oil chamber 308, with the outlet opening 321*a* of said return line being situated beneath the oil level 322. Since the opening 321 of control valve 313 opens beneath the oil level 322 into the oil chamber 308, foaming of the returned oil is prevented. The return line 321 originates from a return opening 330 of control valve 313.

The control piston 315 is pressed by a spring 323 in the direction of the control chamber 316. Once the control pressure $p_{st}$ in the control line as defined by the pressure in the main oil duct 312 exceeds a value predetermined by spring 323, the control piston 315 is displaced against the force of spring 323, through which the opening 320 is released and the pressure lie 318 is relieved. As a result of this control by means of pressure $p_{st}$ in the main oil duct 312, only the quantity required by the internal combustion engine is pressed through the oil filter 310 and oil cooler 311, which enables a very low drive power of pump 302. Fuel can thus be saved. It is still possible to bring the tenacious oil as quickly as possible to the lubrication points during cold starting.

In addition to the control valve 315, a pump safety valve 324 can be provided which is set to a substantially higher pressure and which can also be integrated in the housing 303 of pump 302. The pump safety valve 324 comprises a piston 326 which is displaceable in a cylinder 325 which is connected via a control line 327 with the pressure line 318. The piston 326 of the pump safety valve 324 which is loaded by a spring 328 is thus controlled directly by conveying pressure PD which is applied to the pressure side D of pump 302, with the pressure at which the piston 326 opens a return opening 329*a* for a return line 329 opening into the oil chamber 308 being defined by spring 328.

Although pump 302 is shown in the embodiment as a gear pump, the type of control can be applied in principle to any known pump 302.

The invention claimed is:

1. A liquid-cooled internal combustion engine with a crankcase for several cylinders with a cooling jacket about cylinders in the crankcase, with individual cylinder heads with at least two cooling chambers arranged above one another in the cylinder head, with the cooling jacket of the crankcase and a bottom cooling chamber in the cylinder head being connected with each other via at least one transfer opening per cylinder which are evenly distributed on a circumference of the cylinder, with at least one inlet distributor chamber and/or at least one return collecting chamber for a coolant being arranged along at least one crankcase side wall, wherein the inlet distributor chamber is connected with the cooling jacket of the crankcase as a cylinder liner via at least one connecting duct per cylinder, and wherein an outside wall of the crankcase is curved in a convex manner to an outside in an area of the inlet distributor chamber and/or the return collecting chamber.

2. The internal combustion engine according to claim 1, wherein each connecting duct, when seen in a plan view, opens in a substantially radial manner into the cooling jacket with respect to the cylinder.

3. The internal combustion engine according to claim 1, including a main oil duct, and wherein the connecting duct is arranged between said main oil duct and a return duct connecting the cooling chambers of the cylinder head with the return collecting chamber.

4. The internal combustion engine according to claim 1, wherein the inlet distributor chamber and/or return collecting chamber are arranged integrally with the crankcase.

5. The internal combustion engine according to claim 4, wherein the inlet distributor chamber and/or the return collecting chamber extends over all cylinders arranged in a row.

6. The internal combustion engine according to claim 1, wherein the inlet distributor chamber and/or the return collecting chamber have a substantially semicircular cross section.

7. The internal combustion engine according to claim 1, wherein the return collecting chamber is arranged between a cylinder head sealing plane and the inlet distributor chamber.

8. The internal combustion engine according to claim 1, wherein in an operating position of the internal combustion engine an inlet opening of the connecting duct from the inlet distributor chamber is arranged lower than an outlet opening into the cooling jacket.

9. The internal combustion engine according to claim 1, wherein in an area of a centrally arranged injector at least one transfer opening is arranged between the bottom and the upper cooling chamber, with the transfer opening being formed by an annular gap at least in sections between the intermediate deck and an injector sleeve.

10. A liquid-cooled internal combustion engine with a crankcase for several cylinders with a cooling jacket about cylinders in the crankcase, with individual cylinder heads with at least two cooling chambers arranged above one another in the cylinder head, with the cooling jacket of the crankcase and a bottom cooling chamber in the cylinder head being connected with each other via at least one transfer opening per cylinder which are evenly distributed on a circumference of the cylinder, with at least one inlet distributor chamber and/or at least one return collecting chamber for a coolant being arranged along at least one crankcase side wall, wherein the inlet distributor chamber is connected with the cooling jacket of the crankcase as a cylinder liner via at least one connecting duct per cylinder, wherein an intermediate deck is arranged in the cylinder head between a bottom and a top cooling chamber, with a deck surface of the bottom cooling chamber formed by the intermediate deck being depressed in at least one region in such way that a coolant flow is deflected in a direction of a fire deck, and wherein as a result of a depression of the deck surface, a nozzle-like cross-sectional constriction of the bottom cooling is obtained, with an expansion of a cross-section being formed downstream of the cross-sectional constriction.

11. The internal combustion engine according to claim 10, wherein a deck surface is curved in an area of the depression in a convex manner.

12. The internal combustion engine according to claim 10, wherein a deck surface is curved in an area of the depression in a wave-like manner.

13. The internal combustion engine according to claim 10, wherein upstream and downstream of the depression the deck surface has a rising or falling area, with the area on one side of the depression having a lower slope than the area one an opposite side of the depression.

14. A liquid-cooled internal combustion engine with a crankcase for several cylinders with a cooling jacket about cylinders in the crankcase, with individual cylinder heads with at least two cooling chambers arranged above one another in the cylinder head, with the cooling jacket of the crankcase and a bottom cooling chamber in the cylinder head being connected with each other via at least one transfer opening per cylinder which are evenly distributed on a circumference of the cylinder, with at least one inlet distributor chamber and/or at least one return collecting chamber for a coolant being arranged along at least one crankcase side wall, wherein the inlet distributor chamber is connected with the cooling jacket of the crankcase as a cylinder liner via at least one connecting duct per cylinder, wherein the upper cooling chamber is connected with a push-rod chamber of the cylinder head via at least one transfer opening which is substantially rectangular or triangular.

15. The internal combustion engine according to claim 14, wherein the push-rod chamber is connected via at least one outlet opening and a return duct per cylinder with the return collecting chamber in the crankcase.

16. A liquid-cooled internal combustion engine with a crankcase for several cylinders with a cooling jacket about cylinders in the crankcase, with individual cylinder heads with at least two cooling chambers arranged above one another in the cylinder head, with the cooling jacket of the crankcase and a bottom cooling chamber in the cylinder head being connected with each other via at least one transfer opening per cylinder which are evenly distributed on a circumference of the cylinder, with at least one inlet distributor chamber and/or at least one return collecting chamber for a coolant being arranged along at least one crankcase side wall, wherein the inlet distributor chamber is connected with the cooling jacket of the crankcase as a cylinder liner via at least one connecting duct per cylinder, including an oil cooler upstream of the inlet distributor chamber in a main flow of cooling circulation, and wherein at least one cast slug is arranged on a coolant discharge side of the oil cooler and that an inlet into the inlet distributor chamber is curved in a convex manner at a bottom end of an oil cooler chamber.

17. The internal combustion engine according to claim 16, wherein a longitudinal axis of the oil cooler is arranged in an inclined manner relative to a cylinder head sealing plane at a longitudinal side of the crankcase.

* * * * *